US005110367A

United States Patent [19]

Ahlstrom

[11] Patent Number: 5,110,367

[45] Date of Patent: May 5, 1992

[54] METHOD FOR PRECISION CLEANING OF MEDICAL DEVICES

[75] Inventor: E. Wayne Ahlstrom, Manchester, Mo.

[73] Assignee: Mallinckrodt Specialty Chemicals Company, St. Louis, Mo.

[21] Appl. No.: 701,642

[22] Filed: May 15, 1991

Related U.S. Application Data

[63] Continuation of Ser. No. 507,810, Apr. 12, 1990, abandoned.

[51] Int. Cl.[5] ..... B08B 3/08

[52] U.S. Cl. ..... 134/42; 252/79.5; 252/162; 252/156; 252/541; 422/37

[58] Field of Search ..... 134/34, 42; 252/79.5, 252/162, 156, 541; 422/15, 37

[56] References Cited

U.S. PATENT DOCUMENTS

| | | | |
|---|---|---|---|
| 4,239,661 | 12/1980 | Muraoka et al. | 252/541 |
| 4,339,340 | 7/1982 | Muraoka et al. | 252/79.5 |
| 4,592,856 | 6/1986 | Kobayashi et al. | 134/38 |
| 4,686,002 | 8/1987 | Tasset | 134/34 |

OTHER PUBLICATIONS

Pearson, Frederick C., *Aseptic Pharmaceutical Manufacturing: Technology for the 1990's*, "Pyrogens & Depyrogenation . . . ", Chp. 4, pp. 75–82, (Jul. 1987).

Weary et al., "A Manufacturer's Guide to Depyrogenation", *BioPharm.*, pp. 22–23 and 26–29, Apr. 1988.

*Primary Examiner*—Theodore Morris
*Assistant Examiner*—Zeinab El-Arini
*Attorney, Agent, or Firm*—Rothwell, Figg, Ernst & Kurz

[57] ABSTRACT

A medical device is precision cleaned by being contacted with a choline-containing cleansing agent so as to remove pyrogens from the medical device.

27 Claims, No Drawings

METHOD FOR PRECISION CLEANING OF MEDICAL DEVICES

This application is a continuation of copending application Ser. No. 07/507,810, filed Apr. 12, 1990, and now is abandoned.

BACKGROUND OF THE INVENTION

1. Field of the Invention

The present invention relates to the field of cleaning medical devices prior to use.

2. Description of the Background Art

Modern medical devices such as heart valves, pacemakers, medical parts and tubing, surgical equipment, and the like, are constructed of materials such as stainless steel, pyrolytic carbon, titanium, silicon, butyl rubber, and various plastics such as polyethylene, polypropylene, polyurethane, and the like.

During manufacture, the surfaces of such medical parts often become contaminated with particulate material such as carbon and polish residues, as well as endotoxins and various organic contaminants such as cytotoxic fatty acid residues. The surfaces of medical parts can also become contaminated with ions, and may also require depyrogenation.

In the past, medical parts have been cleaned by vapor degreasing methods utilizing chlorofluorocarbons such as freon. However, the use of chlorofluorocarbons is being increasing curtailed in view of the environmental problems which are thought to be brought about by their use.

Hot hydrogen peroxide has been used in the depyrogenation of medical parts, but has not been shown to be particularly effective therefor. Hot sodium hydroxide has also been used for this purpose.

There remains a need in the art for improved methods for precision cleaning of medical devices.

SUMMARY OF THE INVENTION

In accordance with the present invention, a method for precision cleaning of medical devices comprises contacting a medical device with a cleansing agent comprising choline, so as to remove pyrogens from the medical device.

DESCRIPTION OF THE PREFERRED EMBODIMENTS

The present invention utilizes choline to solve various cleaning problems incurred during the manufacture and final packaging of medical devices such as heart valves, pacemakers, invasive devices such as surgical instruments, catheters, tubing for life supporting fluids such as blood, serum, glucose solutions, and the like, manufactured from such materials as stainless steel, pyrolytic carbon, titanium, silicon, butyl rubber, and various plastics such as polyethylene, polypropylene, polyurethane, etc.

According to the invention, the choline can be present in a solution which may be aqueous or non-aqueous. Examples of non-aqueous solvents which may be utilized to form choline solutions in accordance with the present invention include methanol, ethanol, and propanol.

When utilizing non-aqueous solutions, choline generally is present in the solution at a concentration of from about 0.01% to about 45% by weight, preferably at a concentration of from about 0.05% to about 4% by weight, and most preferably at a concentration of from about 0.1% to about 2% by weight. Non-aqueous choline-containing cleansing agents for use in the present invention may also contain surfactant at concentrations of from about 0.01% to about 2% by weight, in addition to the choline and non-aqueous solvent.

When utilizing aqueous solutions, choline generally is present in the solution at a concentration of from about 0.01% to about 20% by weight, preferably at a concentration of from about 0.05% to about 4% by weight, and most preferably at a concentration of from about 0.1% to about 2% by weight. Aqueous choline-containing cleansing agents for use in the present invention may also contain surfactant at concentrations of from about 0.01% to about 2% by weight, in addition to the choline and aqueous solvent.

According to one embodiment, an aqueous choline solution for use in accordance with the present invention includes a surfactant at a concentration of from about 0.05% to about 0.5% by weight. In preferred embodiments, the surfactant is a nonionic surfactant, such as nonylphenyl polyethoxy nonionic surfactant, polyoxyethylene sorbitan mono-oleate surfactant, and other water soluble or dispersable U.S.P. grade surfactants.

An aqueous choline-containing cleansing agent for use in accordance with the present invention can also include a lower alkanol, having, for example, from 1 to about 3 carbon atoms, the lower alkanol being in the aqueous solution at a concentration of from about 0.1% to about 0.6% by weight. In preferred embodiments, the lower alkanol is methanol.

In preferred embodiments of the present invention, the surface of the medical device to be cleaned is contacted with the choline-containing cleansing agent for a period of from about 1 to about 10 minutes at a temperature of from about 30° C. to about 60° C. In particularly preferred embodiments, the surface to be cleaned is submerged in the choline solution and agitated during the cleansing treatment. Following the cleansing treatment with the choline solution, the treated surface is vigorously rinsed with water for injection or equal quality water and/or isopropyl alcohol, dried, and then packaged for shipment and subsequent use.

The invention is further illustrated by the following examples which are not intended to be limiting.

EXAMPLE 1

A choline solution including 0.5% by weight choline base, 0.45% by weight methanol, 0.3% by weight nonylphenyl polyethoxy nonionic surfactant and the balance water was evaluated for depyrogenation of materials used in medical device construction. The materials tested were as follows.

| Sample No. | Material |
|---|---|
| 1 | Polyethylene sheet stock |
| 2 | Butyl rubber lyophilization stoppers |
| 3 | Silicon surgical tubing |
| 4 | Polyurethane tubing light blue |
| 5 | Polyurethane tubing dark blue |
| 6 | Stainless steel hypodermic needles |
| 7 | Polyurethane fittings, white |
| 8 | Polypropylene syringe barrel |
| 9 | Pyrolytic Carbon/Ti heart valve |

This test involved the use of Purified Lipopolysaccharide (LPS) from *E. Coli* 0.55 B5 (List Biologicals and Endosafe, Inc.), and Limulus Amebocyte Lysate (LAL reagent) (Endosafe, Inc.).

INITIAL SCREEN

Samples to be evaluated were first extracted with LAL reagent water, and a 2-lambda endotoxin spike was added to a portion of each LAL extract to verify absence of any potential interferences with the LAL assay. Results are shown in Table I below.

TABLE I

| Initial Screen of materials to be evaluated | | | |
|---|---|---|---|
| Water Extract | | 2-lambda LPS spike | |
| Sample | Result (EU/ml)* | Sample | Result |
| 1 | −− | 1 | ++ |
| 2 | ++ | 2 | ++ |
| 3 | −− | 3 | ++ |
| 4 | ++ | 4 | ++ |
| 5 | −− | 5 | ++ |
| 6 | −− | 6 | ++ |
| 7 | −− | 7 | ++ |
| 8 | −− | 8 | ++ |
| 9 | −− | 9 | ++ |

*For this test, an LAL gel test of Sensitivity 0.06 EU/ml was used. A negative result means that the sample had less than the detection limit.

ENDOTOXIN CHALLENGE TEST

Multiple samples of each material were placed in sterile polystyrene tubes (Corning) and enough of a 10 ug/ml stock solution of LPS was added to cover the sample. The samples and LPS solutions were then agitated for one hour on an Eberbach shaker table. After agitation, the materials were removed from the tubes and dried in a laminar flow hood.

Duplicate samples of each material were placed in separate Corning tubes for subsequent treatment and evaluation. One set of samples were treated by washing with LAL reagent water at 37° C. with agitation for 10 minutes. A second set were exposed to the choline solution under identical conditions. The wash solutions were discarded, and all samples were extracted with LAL reagent water and the extract subjected to LAL testing. The results are shown in Tables II A and II B below.

TABLE II A

| Test Results of water extract of LPS contaminated materials These results were obtained by Kinetic-Turbidimetric LAL test on a WACO toxinometer ET201 | |
|---|---|
| Sample | LPS level EU/ml |
| 1 | 5.24 |
| 2 | 23.7 |
| 3 | 1.55 |
| 4 | 2.8 |
| 5 | 7.1 |
| 6 | 26.0 |
| 7 | 23.7 |
| 8 | 56.0 |
| 9 | 4.7 |

TABLE II B

| Test results of water extract of choline treated materials. WACO toxinometer ET201. Average result of duplicate assays | |
|---|---|
| Sample | EU/ml |
| 1 | 0.0 |
| 2 | 0.0 |
| 3 | 0.0 |

TABLE II B-continued

| Test results of water extract of choline treated materials. WACO toxinometer ET201. Average result of duplicate assays | |
|---|---|
| Sample | EU/ml |
| 4 | 0.0 |
| 5 | 0.0 |
| 6 | 0.0 |
| 7 | 0.0 |
| 8 | 0.0 |
| 9 | 0.0 |

Following LAL testing by aqueous extraction, the samples were tested by direct exposure to LAL to determine if bound endotoxin might be present which was not removed by either treatment. For this test, pieces of each material were removed by a conventional pyrogenic technique and placed into LAL reaction vials. The reaction vials were incubated and observed for evidence of LPS activity. Some of the materials were not tested in this test due to inability to obtain a suitable sample. The results are shown in Table III below.

TABLE III

| Test results of treated materials exposed directly to LAL | | | |
|---|---|---|---|
| Non-choline treated | | Choline treated | |
| Sample | Result | Sample | Result |
| 1 | ++ | 1 | −− |
| 2 | ++ | 2 | −− |
| 3 | ++ | 3 | −− |
| 4 | ++ | 4 | +−* |
| 5 | ++ | 5 | −− |
| 6 | ++ | 6 | −− |

Explanation of Results:
++ = Activation observed as clotting in LAL reaction tube
−− = No observable activation
* = One of two samples showed slight evidence of activation.

EFFECT OF CHOLINE SOLUTION ON LPS 1 ml of 10 ug/ml stock solution of LPS was mixed with 9ml of the choline solution, vortex mixed and incubated at 37° C. for 30 minutes. The sample was adjusted to pH 7 with pyrogen-free tris-maleate buffer, then serially diluted and tested for LAL reactivity. The results are shown in Table IV below.

TABLE IV

| Results of LAL titration of choline solution treated LPS vs untreated LPS 1.0 ug/ml initial concentration | | |
|---|---|---|
| | LAL gel endpoint | |
| Dilution | Treated | Untreated |
| 1:10,000 | −− | ++ |
| 1:20,000 | −− | ++ |
| 1:40,000 | −− | ++ |
| 1:80,000 | −− | ++ |
| 1:160,000 | −− | −− |

The tested choline solution was shown to destroy the LAL reactivity of LPS upon exposure for 30 minutes at 37° C. Specifically, a concentration of LPS of 1.0 ug/ml was completely inactivated. This concentration is approximately 2,000 times the level which is permissible in medical device extracts (0.05 ng.ml).

The tested choline solution was also effective in the depyrogenation of surfaces of all of the materials tested. Furthermore, the tested choline solution left no interfering residues and had no observable effect on any of the tested materials (embrittlement, discoloration, etc.).

The tested choline solution appears to be more effective in depyrogenation of Lyophilization stoppers than hot hydrogen peroxide (3%), and equally effective as hot NaOH. The tested choline solution has the advantage that it does not appear to chemically attack the stopper material.

Vigorous washing with pyrogen-free water was ineffective in removing LPS from all of the surfaces tested. This has important implications with respect to the adequacy of current test procedures for devices as well as for manufacturing practices. One such implication is that in the case of devices which are substantially exposed to circulating blood of patients, such as implants, indwelling catheters, hemodialysis equipment, etc., pyrogen testing by aqueous extract may not disclose endotoxins which remain adherent to the surfaces of the device and thus may permit exposure.

EXAMPLE 2

Heart valves were cleaned with the choline solution tested in Example 1 at 37° C. for 30 minutes and thereafter tested for fatty acid residues. No fatty acids were detected on the cleaned heart valves.

EXAMPLE 3

Heart valves cleaned in accordance with the procedures set forth in Example 2 were compared to a heart valve cleaned by a conventional vapor degreaser cleaning procedure utilizing Freon, for the presence of surface carbon on the heart valves. The heart valve cleaned by the conventional vapor degreaser cleaning procedure had the highest surface carbon.

The present invention provides a particularly effective method for precision cleaning of medical devices without the environmental and regulatory problems of conventional processes utilizing cholorofluorocarbons such as Freon. Since many modifications, variations and changes in detail may be made to the described embodiments, it is intended that all matter in the foregoing description be interpreted as illustrative and not in a limiting sense.

I claim:

1. A method for precision cleaning of medical devices comprising contacting a medical device which comes into contact with life supporting fluids with a cleansing agent comprising choline, so as to depyrogenate said medical device.

2. The method of claim 1 wherein said choline is in solution.

3. The method of claim 2 wherein the choline solution is non-aqueous.

4. The method of claim 3 wherein the non-aqueous solution contains a solvent selected from the group consisting of methanol, ethanol and propanol.

5. The method of claim 3 wherein the choline is present in the non-aqueous solution at a concentration of from about 0.01% to about 45% by weight.

6. The method of claim 3 wherein said choline is present in the non-aqueous solution at a concentration of from about 0.05% to about 4% by weight.

7. The method of claim 3 wherein the choline is present in the non-aqueous solution at a concentration of from about 0.1% to about 2% by weight.

8. The method of claim 3 wherein said cleansing agent further includes a surfactant.

9. The method of claim 8 wherein said surfactant is present in the non-aqueous solution at a concentration of from about 0.1% to about 2% by weight.

10. The method of claim 2 wherein the choline solution is aqueous.

11. The method of claim 10 wherein the choline is present in the aqueous solution at a concentration of from about 0.1% to about 20% by weight.

12. The method of claim 10 wherein the choline is present in the aqueous solution at a concentration of from about 0.05% to about 4% by weight.

13. The method of claim 10 wherein the choline is present in the aqueous solution at a concentration of from about 0.1% to about 2% by weight.

14. The method of claim 10 wherein the aqueous choline solution further comprises a surfactant.

15. The method of claim 14 wherein said surfactant is non-ionic.

16. The method of claim 15 wherein the surfactant is present in the aqueous solution at a concentration of from about 0.01% to about 2% by weight.

17. The method of claim 15 wherein the surfactant is present in the aqueous solution at a concentration of from about 0.05% to about 0.5% by weight.

18. The method of claim 15 wherein said surfactant is selected from the group consisting of nonylphenol polyethoxy nonionic surfactant and polyoxyethylene sorbitan mono-oleate surfactant.

19. The method of claim 10 wherein said solution further comprises a lower alkanol.

20. The method of claim 19 wherein said lower alkanol is present in the aqueous solution at a concentration of from about 0.1% to about 0.6% by weight.

21. The method of claim 19 wherein said alkanol has from 1 to about 3 carbon atoms.

22. The method of claim 21 wherein said alkanol is methanol.

23. The method of claim 10 wherein said cleansing agent contains choline base at a concentration of about 0.5% by weight, methanol at a concentration of about 0.45% by weight, and nonylphenol polyethoxy nonionic surfactant at a concentration of about 0.3% by weight.

24. The method of claim 1 wherein the medical device is contacted with said cleansing agent for a period of from about 1 to about 10 minutes.

25. The method of claim 1 wherein the medical device is contacted with said cleansing agent at a temperature of from about 30° C. to about 60° C.

26. The method of claim 1 wherein the medical device is selected from the group consisting of heart valves, pacemakers, invasive devices, surgical instruments, catheters and tubing for life supporting fluids.

27. The method of claim 1, further including the step of packaging the depyrogenated medical device.

* * * * *